United States Patent [19]

Matzinger et al.

[11] Patent Number: 4,552,049

[45] Date of Patent: Nov. 12, 1985

[54] AUTOMATIC FEEDING OF ELONGATED PRODUCTS

[75] Inventors: Martin J. Matzinger; Daniel L. Orloff, both of Madison, Wis.

[73] Assignee: Oscar Mayer Foods Corporation, Madison, Wis.

[21] Appl. No.: 526,715

[22] Filed: Aug. 26, 1983

[51] Int. Cl.[4] ..... B26D 7/06

[52] U.S. Cl. ..... 83/27; 83/42; 83/104; 83/165; 83/277; 83/281; 83/409; 83/417

[58] Field of Search ..... 83/104, 165, 206, 277, 83/278, 279, 280, 281, 355, 409, 417, 437, 612, 27, 42, 102; 414/15-18; 198/408, 457, 489, 480

[56] References Cited

U.S. PATENT DOCUMENTS

| | | | |
|---|---|---|---|
| 1,892,670 | 1/1933 | Jaeger | 198/480 |
| 2,366,615 | 1/1945 | Hansen | 198/480 |
| 2,832,388 | 4/1958 | Folk | 83/277 |
| 3,162,226 | 12/1964 | Toby et al. | 83/206 |
| 3,185,006 | 5/1965 | Mercer et al. | 83/364 X |
| 3,871,511 | 3/1975 | Wentz | 198/480 X |
| 4,015,494 | 4/1977 | Spooner et al. | 83/409 X |
| 4,220,241 | 9/1980 | DeGray | 198/408 |
| 4,321,847 | 3/1982 | Dillon | 83/278 X |
| 4,457,194 | 7/1984 | Mally | 83/417 |

*Primary Examiner*—James M. Meister

*Attorney, Agent, or Firm*—Joseph T. Harcarik; Thomas R. Savoie; Daniel J. Donovan

[57] ABSTRACT

An apparatus and method are provided for feeding elongated products, especially food products having generally square cross-sections. Included is a transporting assembly that has a surface for receiving the products and moving them in a direction generally transverse to their longitudinal axes. An escapement assembly is provided near the downstream end of the transporting assembly in order to move the products one at a time to a product feed assembly. Typically, the product feed assembly pushes the product to a slicing device to thereby provide stacks of sliced product.

22 Claims, 6 Drawing Figures

5

6
6
22
22a
38
22
42
45
40
39
38
5

AUTOMATIC FEEDING OF ELONGATED PRODUCTS

BACKGROUND AND DESCRIPTION OF THE INVENTION

This invention generally relates to an apparatus and method for handling elongated products, more particularly to an arrangement including a magazine assembly for orienting elongated sticks or loaves of food product such that they are aligned for feeding in a direction generally along their respective longitudinal axes. The invention is especially well-suited for handling a product that has a generally square cross-section.

High volume production of products such as sliced food includes initially forming the products as large elongated sticks or loaves of sausage, cheese, or the like and subsequently slicing the products and packaging the slices within generally uniform packages in a manner that is suitable for high speed production of a conveniently packaged product of the type that is well-suited for mass marketing. Certain of these elongated sticks or loaves have a generally square cross-section, which increases the difficulty of moving these elongated heavy products, particularly when compared with elongated products of the same general size but having a circular cross-section that allows them to be readily rolled along their respective axes within, for example, a gravity-fed magazine.

An elongated product having a square cross-section is not well-suited for, and can be damaged by, handling that includes rolling or sliding in a direction transverse to the product's longitudinal axis. For example, if an elongated product that is square in cross-section were to be handled by a gravity-fed magazine, the product would tend to tumble and slide in a generally inconsistent and uncontrolled manner, which could damage the product and result in feeding mis-alignment.

Accordingly, there is a need for a food product feed mechanism, particularly an apparatus and method suitable for feeding a large stick or loaf of food product having a generally square cross-section, through a slicing device or the like. Such is accomplished by the present invention which includes an assembly for receiving and transporting one or more generally parallel food products, this assembly including a surface that moves in a direction generally transverse to the longitudinal axes of the products. The apparatus further includes an escapement assembly for receiving each product one at a time along a longitudinal surface thereof and for moving same to an assembly that feeds the product along its longitudinal axis, for example, through an automatic slicing apparatus.

It is accordingly a general object of the present invention to provide a magazine apparatus and method for collecting elongated products and dispensing them one at a time.

Another object of the present invention is to provide an improved apparatus and method that feeds a plurality of elongated generally square products along their respective axes through an automatic slicing device.

Another object of this invention is to provide an improved apparatus and method for forming stacks of sliced food product having a generally square cross-section.

Another object of this invention is to provide an improved feeding apparatus and method having a generally self-actuating member for holding down a stick or loaf of food product as it is fed through an automatic slicer.

Another object of the present invention is to provide as improved apparatus and method utilizing a walking beam arrangement for moving a stick or loaf in a direction generally perpendicular to its longitudinal axis.

Another object of this invention is to provide an improved apparatus and method incorporating a paddle shaft escapement arrangement.

These and other objects of the present invention will become apparent from the following detailed description of this invention, taken in conjunction with the accompanying drawings, wherein.

Figure 1:
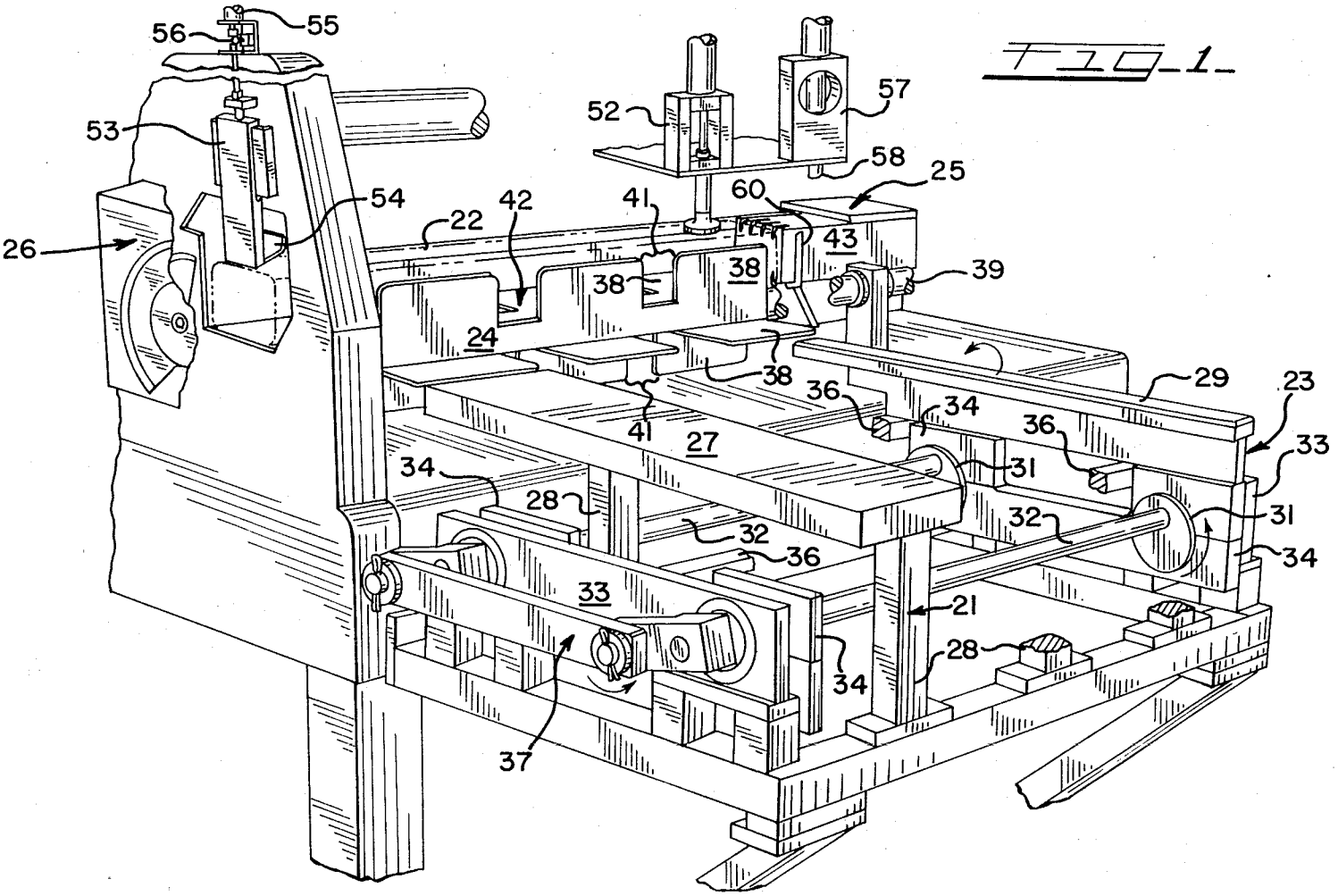
FIG. 1 is a perspective view of a preferred embodiment of the apparatus according to this invention.

With reference to the preferred structure of the invention that is illustrated in FIG. 1, such includes a platform assembly, generally designated as 21, for receiving and collecting a plurality of elongated products 22. A transporting assembly, generally designated as 23, moves the elongated products 22 to an escapement assembly, generally designated as 24. The escapement assembly 24 provides elongated products 22 one at a time to a feed assembly, a generally designated as 25, which feeds an elongated product 22 to a product handling station such as an automatic slicer 26 of known construction as generally illustrated.

Figure 2:
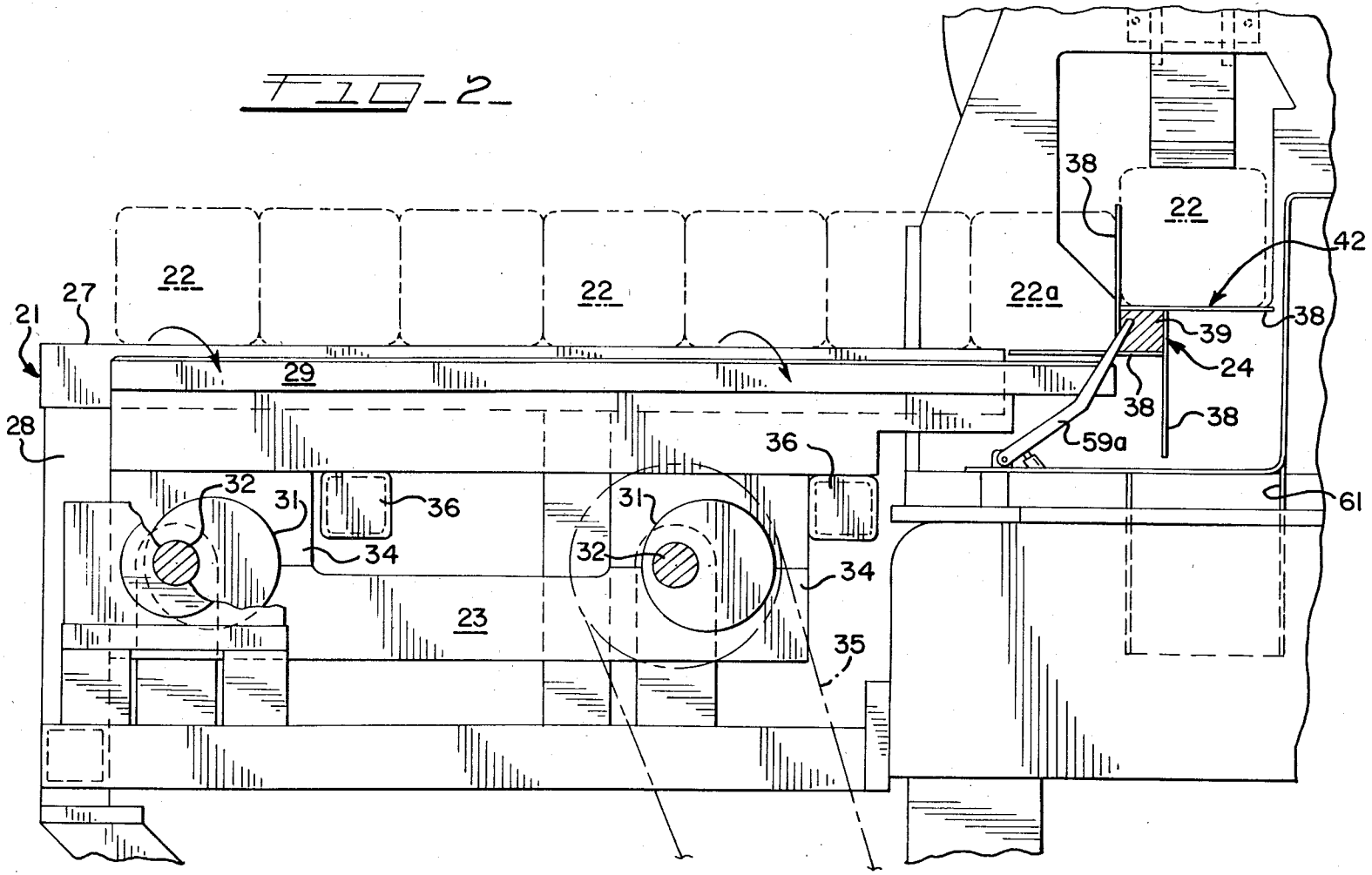
FIG. 2 is an elevational view of the rear end of the apparatus of FIG. 1, away from which the product is fed for slicing or other handling.
Figure 3:
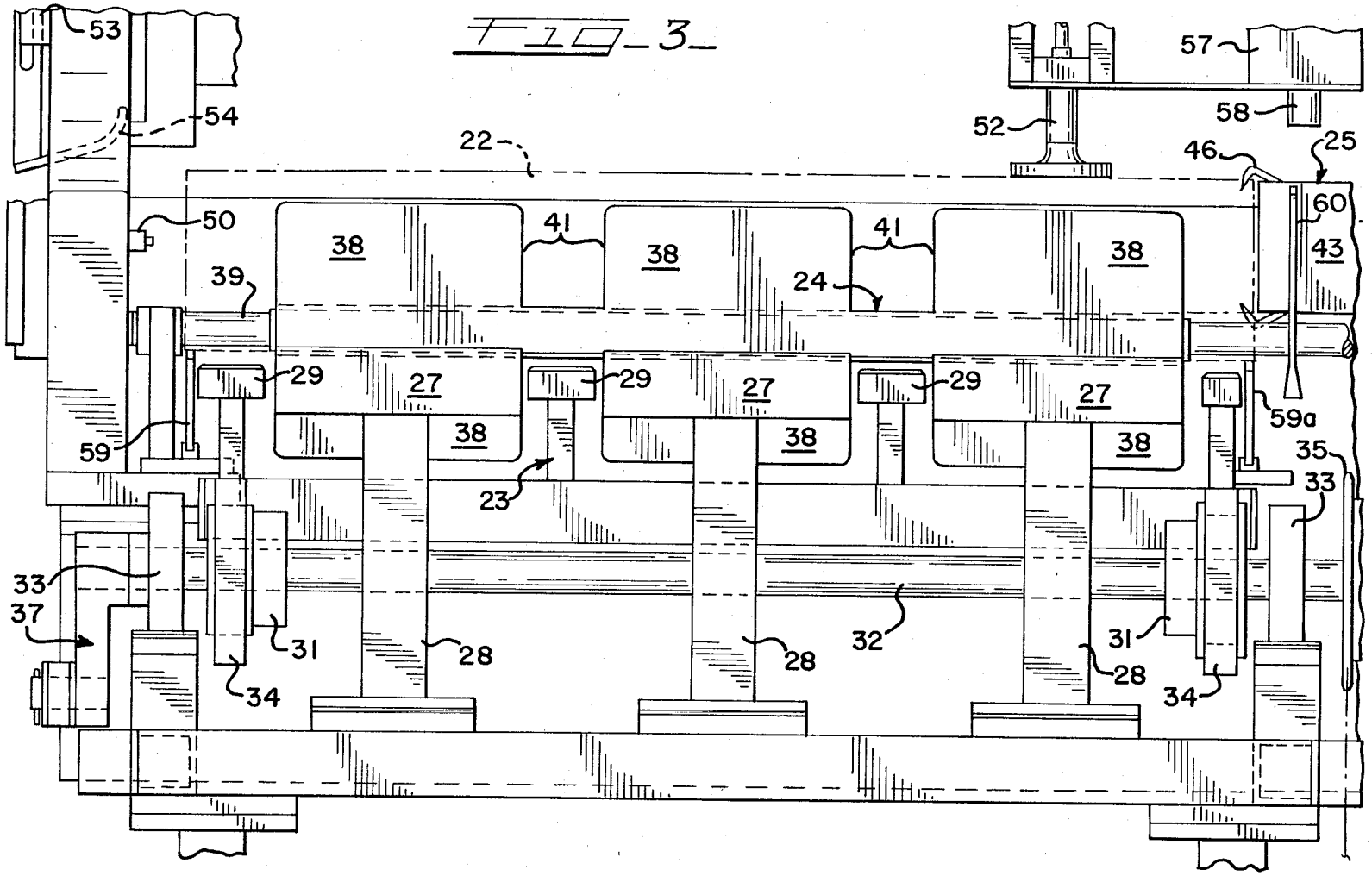
FIG. 3 is a side elevational view of the apparatus of FIG. 1.
Figure 4:
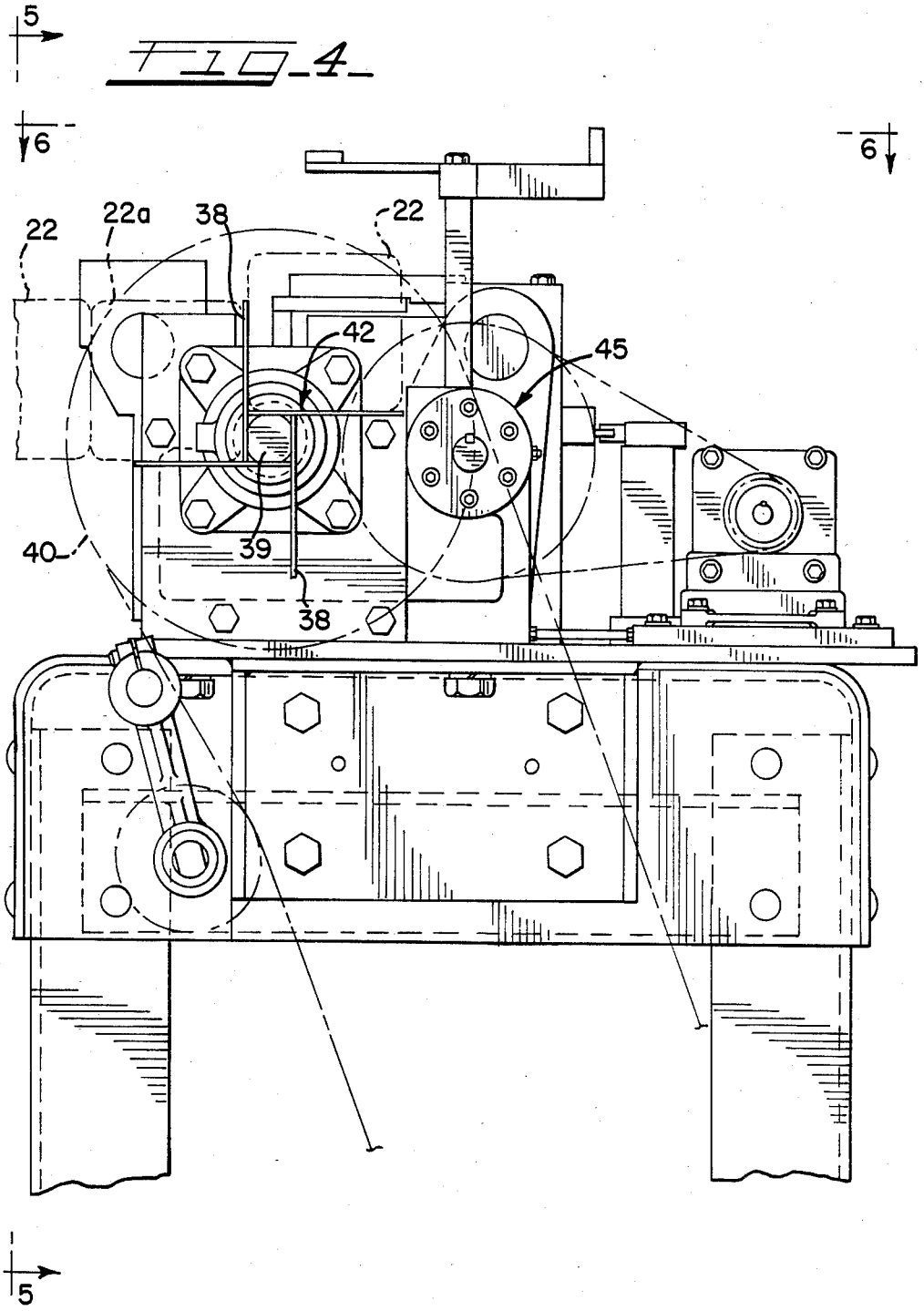
FIG. 4 is a detailed rear end view of the apparatus according to FIG. 1.

As further illustrated in FIGS. 2 and 3, the platform assembly 21 includes a plurality of stationary platforms 27 having supports 28. The preferred transporting assembly 23 includes a plurality of walking beams 29 that are alternately located between and spaced so as to clear the stationary platforms 27. Transporting assembly 23 moves the walking beams 29 above the stationary platforms 27 while they also move in a direction generally toward the escapement assembly 24 in order to steadily and positively move the elongated products 22 along the platform assembly 21 and toward the escapement assembly 24.

With more particular reference to the transporting assembly 23, such includes an offset rotation arrangement. The illustrated offset rotation arrangement includes eccentric members 31 mounted near opposing ends of a shaft 32, which is rotatably mounted by suitable structure such as the illustrated cylindrical bearing bars 33. Rotatably mounted onto each eccentric member 31 is a split bearing assembly 34 or the like. When a suitable drive assembly 35 rotates the shaft 32, the rotating shaft 32 drives the eccentric member 31, which in turn translates the split bearing assembly 34 in an offset manner, thereby moving each walking beam 29 in substantially the same offset manner.

Regarding the offset translational movement of the walking beams 29, the consistency of such movement among the several walking beams 29 is assured by structures such as the illustrated tie bars 36 and crank assembly 37. By this arrangement, the walking beams 29 move in unison in a substantially circular manner as illustrated. This circular movement is carried out such that the walking beams 29 are generally above the stationary platforms 27 at a time when the walking beams 29 are moving generally toward the escapement assembly 24, and the walking beams 29 are below the top surface of the stationary platforms 27 while the walking beams are moving generally away from the escapement assembly 24. The resultant movement of the walking beams 29 of the transport assembly 23 is such that elongated products 22 alternate between resting upon the stationary platforms 27 and being lifted off of the platforms 27 and, when not impeded by a downstream elongated product 22, moved a distance toward the escapement assembly 24.

With more particular reference to the escapement assembly 24, the preferred structure thereof includes a gate arrangement for movement of an elongated product 22 from the transporting assembly 23 and for dispensing same to the feed assembly 25.

Referring to FIGS. 1, 2, 3 and 4, the preferred structure of the escapement assembly 24 includes a rotating paddle arrangement wherein a plurality of paddle members 38 are mounted generally transversely to each other along a rotating shaft 39 rotated by a suitable drive assembly 40. Preferably, the paddle members 38 are spaced or slotted in order to provide a clearance 41 for accommodating movement of the walking beams 29 to the extent that a vertically oriented paddle member 38 will halt horizontal movement of the elongated product 22*a* adjacent thereto, even if the walking beams 29 continue to lift the elongated product 22*a* and return same back down to the horizontally disposed paddle 38 and/or the stationary platforms 27. Escapement assembly 24 receives each elongated product 22 and moves it to the feed assembly 25 when such movement is called for during a cycle of the apparatus and method.

Feed assembly 25 moves an elongated product 22 in a direction generally along its axis and that is transverse to the direction that the elongated products 22 are moved by the transporting assembly 23. A preferred interaction between the escapement assembly 24 and the feed assembly 25 includes having a portion of the escapement assembly 24, preferably paddle members 38, provide a generally horizontal support surface, generally designated as 42, of the feed assembly 25. An elongated product 22 slides along this horizontal support surface 42 while it is being fed by the feed assembly 25. Supplemental product supports can be provided as desired, for example, at the clearance 41 of the paddle members 38.

Referring more particularly to the feed assembly 25 illustrated in FIGS. 1 through 6, a gripper assembly 43 is mounted to a carriage assembly 44, which is in turn moved in either a feed direction or a retract direction along a generally horizontal axis, whereby the gripper assembly 43 moves generally horizontally above the support surface 42. A suitable drive assembly in this regard can include a screw and ball nut assembly 45 as illustrated.

Figure 5:
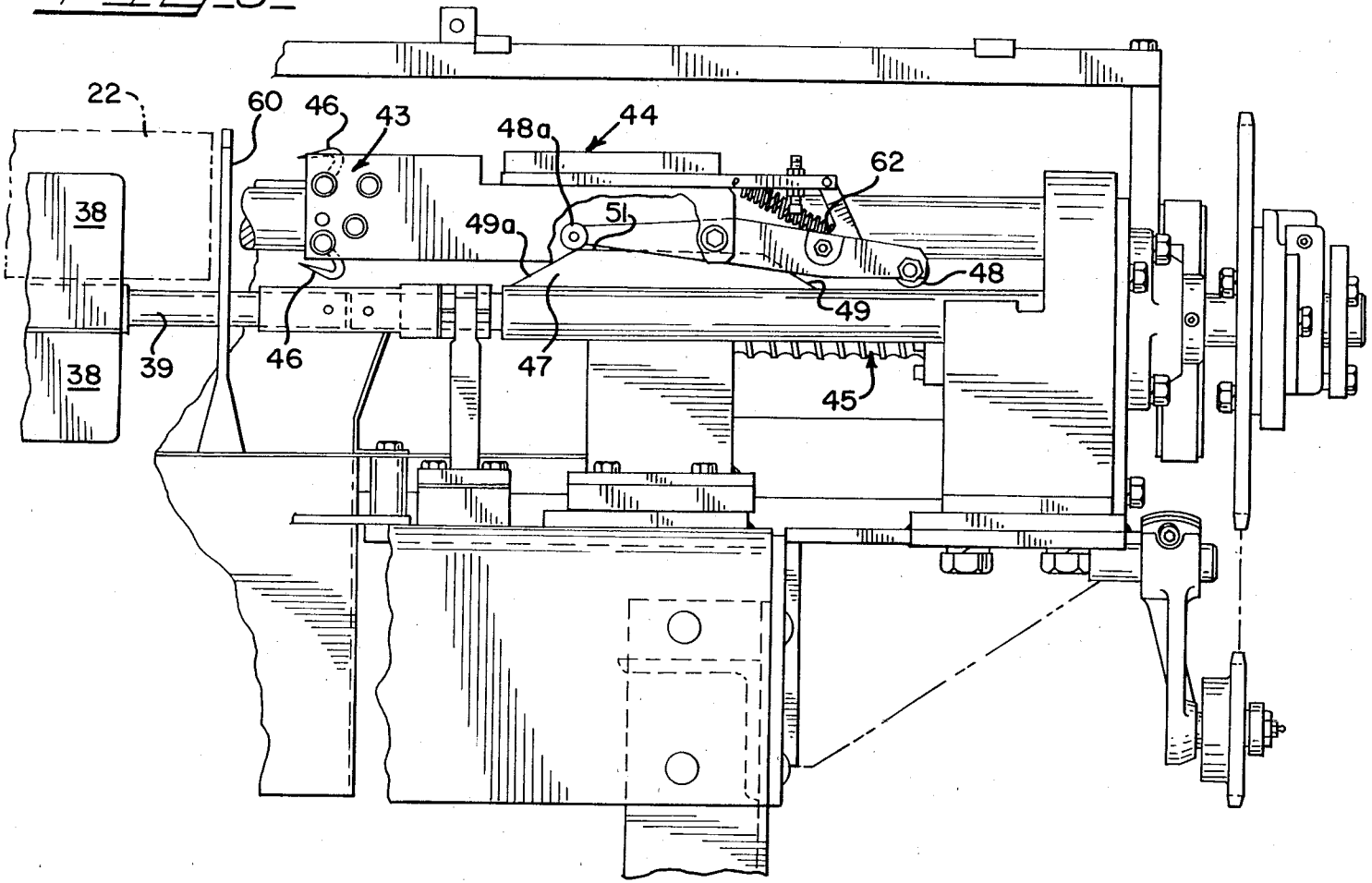
FIG. 5 is an elevational view generally along the line 5—5 of FIG. 4.
Figure 6:
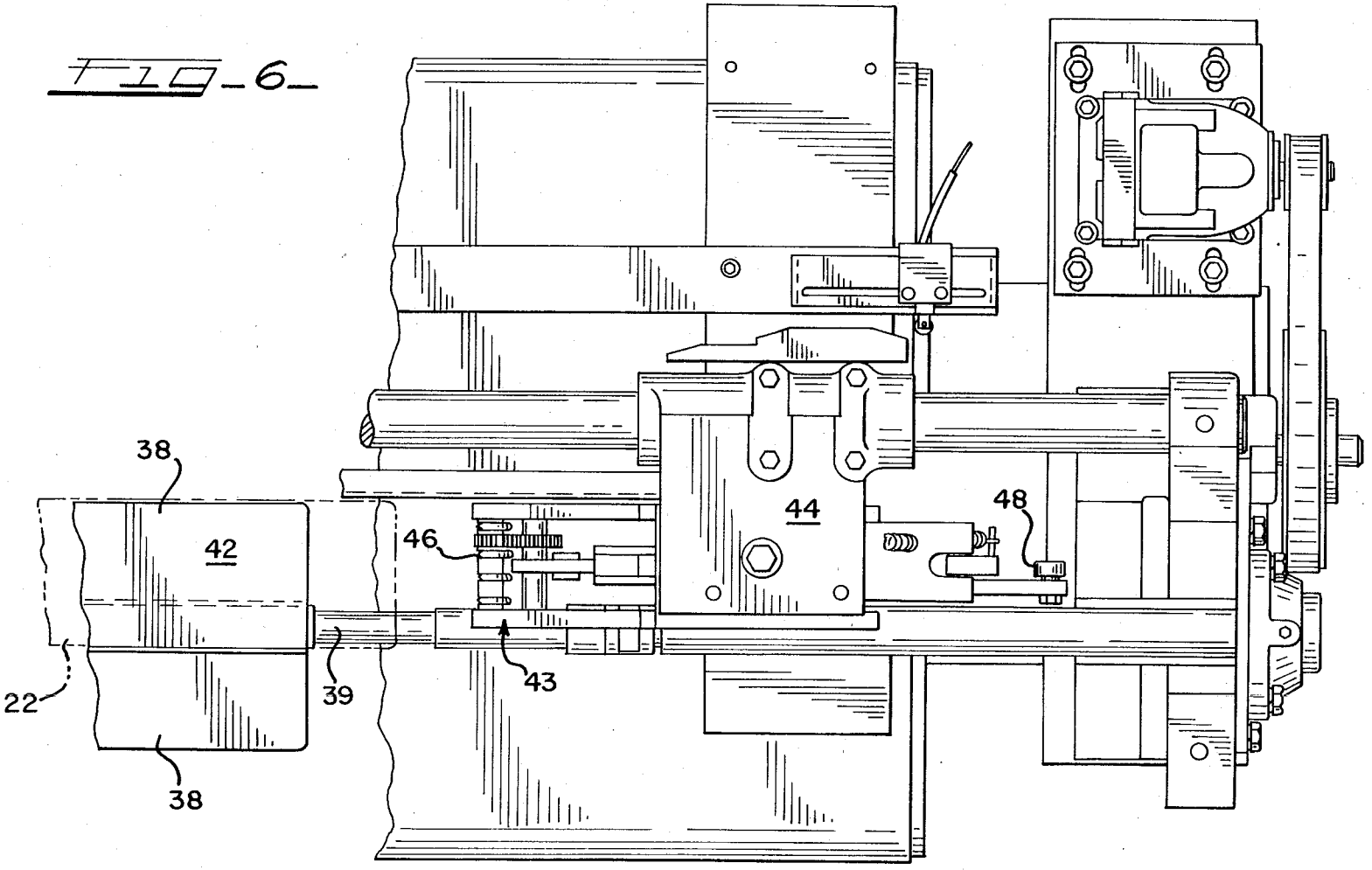
FIG. 6 is a top plan view generally along the line 6—6 of FIG. 4.

With reference to the gripper assembly 43, same includes a plurality of pivotable hooks 46, the gripping position thereof being shown in FIGS. 1 and 3, and the non-gripping position thereof being illustrated in FIGS. 5 and 6. A gripper cam 47 is provided for opening or closing the gripper assembly 43 by movement of cam followers 48, 48*a*. More particularly, cam follower 48 engages a slope 49 of the gripper cam 47 to close the pivoting hooks 46 when the gripper assembly 43 moves forwardly with respect to its location shown in FIG. 5. The gripper assembly 43 is fully closed when the cam follower 48 engages an apex 51 of the gripper cam 47. Such closed orientation is maintained by a spring loaded latch detent 62 even after the cam follower 48 clears the gripper cam 47 as the gripper assembly 43 continues to move forwardly. This closed orientation is further maintained when the gripper assembly 43 moves rearwardly until such time as the cam follower 48*a* engages the slope 49*a* to release the latch detent 62 and open the pivoting hooks 46, which remain open while the gripper assembly 43 continues to move rearwardly for a distance that is adequate to facilitate removal to therefrom of a butt remainder of the product 22.

A clamp assembly 52 is preferably provided for engaging the elongated product 22 in order to secure same in place while the hooks 46 enter the rear end of the elongated product 22 as generally illustrated in FIG. 3. This clamp assembly 52 is actuated for movement to its hold-down position by a suitable limit switch or the like that is activated after the escapement assembly 24 has positioned an elongated product 22 onto the support surface 42. Such hold-down position of the clamp assembly 52 assists in preventing forward movement of the elongated product 22 in response to penetrating engagement thereof by the pivoting hooks 46. A further control device such as a limit switch or the like subsequently releases the clamp assembly 52 such that same is clear of the gripper assembly 43 as it moves the elongated product 22 along the support surface 42.

With reference to FIGS. 1 and 3, a hold-down assembly 53 may be provided near the front end of the apparatus in order to guide the front portion of the elongated product 22 as it is fed, for example, through the slicer 26. Hold-down assembly 53 also prevents the elongated product from being uncontrollably pulled through the automatic slicer 26 in the event that the gripper assembly 43 had not adequately secured the rear end of the elongated product 22, which might occur, for example, if a butt end of a previously fed elongated product was not adequately ejected from the gripper assembly 43 before a following elongated product was positioned onto the support surface 42.

The illustrated hold-down assembly 53 is a self-actuating clamp which is actuated when a foot bracket 54 thereof contacts the leading end of the elongated product 22. Its preferred structure includes an air cylinder 55 and a limit switch 56. Prior to contacting an elongated product 22, the foot bracket 54 is in its downwardmost position at a height at which a portion thereof is below the top surface of an elongated product 22. When the leading edge of the elongated product 22 contacts the foot bracket 54, the foot bracket 54 moves upwardly and actuates the limit switch 56 which in turn actuates the cylinder 55 in order to maintain a glancing downward pressure on the elongated product 22 as it passes along the bottom surface of the foot bracket 54.

After the gripper assembly 43 moves beyond a certain location generally along the support surface 42, an appropriate actuator, generally illustrated at 50 in FIG. 3, de-activates the cylinder 55 so that the foot bracket 54 no longer bears down upon the remaining portion or butt of the elongated product in order to prevent the butt from being pulled out of the gripping assembly 43 when the gripping assembly 43 is retracted. Preferably, this actuating device 50 also initiates retraction of the gripping assembly 43.

Retraction is initiated when the gripper assembly 43 reaches a predetermined location in the feed direction, which occurs when the elongated product 22 has been substantially fed through the apparatus, for example when it has been reduced to a desired butt size. When this predetermined location is signaled by the actuator 50 or an appropriately positioned limit switch or the like, the screw and ball nut assembly 45 reverses from its feed direction and moves in its retract direction.

Typically at the time that the screw and ball nut assembly 45 approaches the end of its retract mode, the butt contacts and is removed from hooks 46 by a fixed stripper member 60. An eject assembly 57 is energized to extend a finger 58 thereof to a location below the upper surface of the butt to insure removal of the butt from the face of the gripper assembly 43 after same has moved rearwardly past the fixed stripper member 60 and past the finger 58. Butts removed from the gripper assembly 43 are collected through a chute 61 (FIG. 2) or the like. By about the time that the butt first engages the fixed stripper member 60, the hooks 46 have been pivoted to their generally open or non-gripping position by engagement of the cam follower 48*a* and the slope 49*a* of the gripper cam 47.

A pair of limit switches 59, 59*a* (FIGS. 2 and 3) are preferably provided in conjunction with the transporting assembly 23 and the escapement assembly 24. Such limit switches 59, 59*a* are positioned near generally opposite ends of the escapement assembly 24 such that generally opposite ends of the elongated product 22 will depress or otherwise activate the limit switches 59, 59*a*. It is preferred that appropriate circuitry be provided such that both of the limit switches 59 and 59*a* must be activated in order to signal subsequent cycles steps. For example, if a broken, shorter elongated product reaches the escapement assembly 24, or if the product is not squarely aligned therewithin, the cycle of the apparatus will be interrupted because both ends of such a product will not be in engagement with a limit switch 59, 59*a*.

With more particular reference to subsequent cycles, activation of the limit switches 59, 59*a* typically stops movement of the transporting assembly 23. Preferably, the transporting assembly 23 remains at rest until such time as the indexing cycle of the escapement assembly 24 is completed in order to minimize any possibility of damage to the elongated products 22 caused by continued operation of the transporting assembly 23 without operation of the escapement assembly 24. Once the feed assembly 25 has completed both the feed cycle and the retract cycle, a signal is provided to the escapement assembly 24 to initiate operation thereof. Provided the limit switches 59, 59*a* are activated by a correctly positioned elongated product 22, the escapement assembly 24 then places an elongated product 22 onto the support surface 42 of the feed assembly 25.

If the limit switches 59, 59*a* are not so activated, a signal is transmitted to the transporting assembly 23 to effect movement of elongated products 22 thereon until such movement activates the limit switches 59, 59*a*. Even if one or more of the elongated products 22 are placed on the transporting assembly 23 in a manner that is not generally parallel to the escapement assembly 24, the transport assembly 23 continues to operate until such time as the desired parallel relationship is achieved, which is signaled by activation of both of the limit switches 59, 59*a*. Once the escapement assembly 23 deposits an elongated product 22 on the support surface 42, the feed assembly 45 is activated and feeding is begun.

Inasmuch as this invention can be embodied in various forms, it is to be construed and limited only by the scope of the appended claims.

What is claimed is:

1. An apparatus for handling elongated food products, comprising:

platform means for receiving a plurality of elongated products;

transporting means in association with said platform means, said transporting means moving the elgonated products with respect to the platform means, said transporting means having an assembly including product receiving surfaces that move in a direction generally transverse to the respective longitudinal axis of the products wherein said transport means includes a walking beam assembly having a walking beam that moves in a direction generally toward an escapement means;

escapement means for serially receiving said elongated products from said transporting means and for moving said products one at a time in a direction generally transverse to their respective longitudinal axis wherein said escapement means includes a rotatable paddle assembly, the axis of rotation of the paddle assembly oriented generally parallel to the axis of an elogated product within the escapement means; and feed assembly including means for moving the elongated product in an upstream direction generally along the longitudinal axis thereof which includes a moving gripper assembly that translates along a feed-and-retract path that is generally parallel to the axis of an elongated product within the feed assembly.

2. The apparatus of claim 1, further including slicer means near the downstream end of the feed assembly for slicing the elongated product.

3. The apparatus of claim 1, wherein said platform means includes a plurality of stationary platforms and wherein said transporting means further comprising a plurality of walking beams that generally alternate with and that are generally parallel to said plurality of stationary platforms.

4. The apparatus of claim 1, wherein an elongated product support surface is common to said escapement means and to said feed assembly.

5. The apparatus of claim 1, wherein said feed assembly includes gripper actuating means for securing a trailing end of the elongated product at a predetermined location of the feed assembly and for releasing such securement at another predetermined location, said securing predetermined location being upstream of said releasing predetermined location.

6. The apparatus of claim 1, wherein said feed assembly includes a gripper means for securing a trailing end of the elongated product and clamp means for engaging the elongated product at a location spaced from the trailing end.

7. The apparatus of claim 1, wherein said feed assembly includes a hold-down assembly having a foot bracket that imparts a glancing pressure on the elongated product within the feed assembly when the elongated product is moving in a feed direction.

8. The apparatus of claim 7, further including means for releasing the glancing pressure applied by the foot bracket when the product initially moves in a retract direction.

9. The apparatus of claim 1, wherein said feed assembly includes stripper means for engaging a residual butt of the product and for removing same from the feed assembly during a retract mode of the feed assembly.

10. The apparatus of claim 1, wherein said escapement means includes detection members positioned at generally opposite ends of the escapement means, said detection members being located for activation thereof by opposite ends of elongated product within said escapement means.

11. The apparatus of claim 10, wherein said detection members control operation of said escapement means and of said transporting means.

12. A method for hanlding elongated food products, comprising:

receiving one or more elgonated products on a platform surface;

transporting the elongated products along the platform surface by moving the elgonated products with respect to the platform surface and without rotating the elgonated products, said moving being in a direction generally transverse to the respective longitudinal axis of the elongated products, and said movement being in an escapement position wherein said transporting step includes lifting the elongated products and moving same towards said escapement position;

dispensing the elongated products one at a time from said escapement position in a direction generally transverse to their respective longitudinal axis wherein said dispensing step includes rotating said elongated product along an axis that is generally parallel to the longitudinal axis of the elongated product; and feeding the dispensed elongated product by moving same through a feeding path in a direction generally along the longitudinal axis thereof wherein said feeding step includes gripping the trailing end of the elongated product.

13. The method of claim 12, further including slicing the elongated product in association with said feeding step.

14. The method of claim 12, wherein said feeding step includes gripping the trailing end of the elongated product while applying a force to the elongated product in a direction generally transverse to the longitudinal axis thereof and at a location near the trailing end thereof.

15. The method of claim 12, wherein said feeding step includes applying pressure to the elongated product in a direction generally transverse to the longitudinal axis thereof and while the product is moving in the feed direction.

16. The method of claim 12, further including a retracting step subsequent to said feeding step, wherein said feeding step includes applying pressure to the elongated product in a direction generally transverse to the longitudinal axis thereof and while the product is moving in the feed direction, and wherein said pressure applying step is suspended during said retracting step.

17. The method of claim 12, further including a retracting step subsequent to said feeding step, said retracting step including ejecting a residue product from out of said feeding path.

18. The method of claim 12, further including detecting the presence of an elongated product at said escapement position, said detecting step controlling operation of said transporting step and of said dispensing step.

19. The method of claim 12, further including detecting the presence of an elongated product at said escapement position, said detecting step signalling interruption of said transporting step.

20. The method of claim 12, further including detecting the presence of an elongated product at said escapement position, said detecting step signalling interruption of said transporting step until said dispensing step has been completed.

21. The method of claim 12, further including detecting the presence of an elongated product at said escapement position, said detecting step signalling initiation of said dispensing step.

22. The method of claim 12, further including a step of detecting the presence of an elongated product at said escapement position, and a retracting step that is subsequent to and that generally reverses said feeding step, said detecting step signalling initiation of said dispensing step after said feeding step and said retracting step having been substantially completed.

* * * * *